US009775382B2

(12) United States Patent
Wang

(10) Patent No.: US 9,775,382 B2
(45) Date of Patent: Oct. 3, 2017

(54) MULTIPLE MODE VAPOR GENERATOR

(71) Applicant: Dan Wang, Shanghai (CN)

(72) Inventor: Dan Wang, Shanghai (CN)

( * ) Notice: Subject to any disclaimer, the term of this patent is extended or adjusted under 35 U.S.C. 154(b) by 152 days.

(21) Appl. No.: 14/739,181

(22) Filed: Jun. 15, 2015

(65) Prior Publication Data

US 2016/0360788 A1 Dec. 15, 2016

(51) Int. Cl.
*A24F 47/00* (2006.01)

(52) U.S. Cl.
CPC ..... *A24F 47/008* (2013.01)

(58) Field of Classification Search
CPC ..... A24F 47/008; A24F 47/00; A24F 47/002; A24F 47/004; A24F 47/006; A24F 13/00; A24F 13/02; A24F 13/08; A24F 13/18; A24F 13/22; A61M 15/06
USPC ..... 131/178, 179, 329
See application file for complete search history.

(56) References Cited

U.S. PATENT DOCUMENTS 6,418,936 B1 * 7/2002 Lee ..... A24F 5/00 131/178
2011/0226266 A1 * 9/2011 Tao ..... A24F 3/00 131/185
2012/0118307 A1 * 5/2012 Tu ..... A24F 47/008 131/331
2013/0192615 A1 * 8/2013 Tucker ..... A24F 47/008 131/329
2015/0053221 A1 * 2/2015 Asghar-Sheikh ..... A24F 47/008 131/329
2015/0101622 A1 * 4/2015 Liu ..... A24F 47/008 131/328
2015/0245658 A1 * 9/2015 Worm ..... A24F 47/008 131/328
2015/0272214 A1 * 10/2015 Giller ..... A24F 47/002 131/329
2016/0198767 A1 * 7/2016 Verleur ..... A24F 47/008 392/386
2016/0366936 A1 * 12/2016 Liu ..... A24F 47/008
2016/0368693 A1 * 12/2016 DeWitt ..... A24F 15/20

FOREIGN PATENT DOCUMENTS

DE 10106396 A1 * 8/2002 ..... A24F 1/30

OTHER PUBLICATIONS

Merriam-Webster.com, "Bias.", n.d., Merriam-Webster, Web, Jan. 17, 2017.*

* cited by examiner

*Primary Examiner* — Michael H Wilson
*Assistant Examiner* — Sonny Nguyen
(74) *Attorney, Agent, or Firm* — Clement Cheng

(57) ABSTRACT

The electronic cigarette device releasably houses a plurality of electronic cigarettes around a central shaft and between an upper bracket and a lower bracket, a cigarette holder, and the first frame. The first cigarette holder, the holder, the central shaft, the holder and lower bracket are sequentially connected. The central shaft ends are provided in a sleeve on the stand and holder, and a plurality of electronic cigarettes are disposed between the upper bracket and the bracket, and on display around the central shaft of circumferentially distributed. The first cigarette holder end surface has a cigarette jack, cigarette jack first communicating hole. In the second end of the central shaft, the connector sleeve is provided.

14 Claims, 5 Drawing Sheets

MULTIPLE MODE VAPOR GENERATOR

This application claims priority from and is a continuation in part of China Patent (CN204032369U) application number 201420468040.4 entitled Electronic Cigarette With Multiple Atomizers filed Aug. 19, 2014 and issued Dec. 24, 2014, by same inventors Dan Wang and Yanmin Nie, the disclosure of which is incorporated herein by reference, the certified copy of which is also incorporated herein by reference according to the priority document exchange agreement (PDX) between the United States Patent and Trademark Office and the State Intellectual Property Office of the People's Republic of China (CN) effective Oct. 8, 2014.

TECHNICAL FIELD

The invention relates to the field of electronic cigarettes, in particular to multiple mode and large capacity electronic cigarette.

BACKGROUND

Parent application China Patent (CN204032369U) entitled Electronic Cigarette With Multiple Atomizers filed Aug. 19, 2014 and issued Dec. 24, 2014, the disclosure of which is incorporated herein by reference, discloses a plurality of electronic cigarette atomizers, including an electronic cigarette with cigarette holders, an upper cigarette holder frame, a lower cigarette holder frame, an upper atomizer support, the atomizers, a center shaft, outer threads, a lower atomizer support, a threaded hole and a bottom cover. The upper end of the center shaft is connected with a center shaft insertion hole of the upper atomizer support. The outer threads at the lower end of the center shaft are in threaded connection with the threaded hole of the lower surface of the lower atomizer support. The bottom cap is connected with the lower surface of the lower atomizer support. The atomizers are clamped between the lower end of the upper atomizer support and a bottom cap. Multiple sockets are formed around the center shaft insertion hole of the upper atomizer support. The cigarette holders of the atomizers are inserted into the sockets respectively. The lower electronic cigarette holder frame is provided with multiple cigarette holder insertion holes. The lower end of the lower cigarette holder frame is connected with the upper end of the upper atomizer support in a sealed mode. The upper end of the lower cigarette holder frame is connected with the lower end of the upper cigarette holder frame in a sealed mode, and the cigarette holders are connected with the upper end of the upper cigarette holder frame. The electronic cigarette is composed of the atomizers and capable of being used by multiple persons in multiple modes.

The atomizer bracket around the central shaft of the jack is provided with a plurality of sockets, with each nebulizer mouthpiece respectively inserted into each socket. The atomizer can be replaced with mini electronic cigarettes, and each mini electronic cigarette has on their bottom portions one or more diamond lights. Diamond lights are lights having a lens that is shaped like a princess cut diamond such that the diamond shaped lens provides a prismatic, iridescent or otherwise sparkly effect. The plurality of electronic cigarette atomizers can produce large amounts of smoke to meet the needs of multiple smokers. It can be used as an e-cigarette holder for separate single use, or combined for Indian hookah to be used by many people. Such diverse usage options increases a user's experience.

However, there are some drawbacks in the above configuration disclosed in the parent application. For example, if the bottom of the mini electronic cigarette is provided with a diamond light, the bottom cover socket needs to reflect or allow transmittance of the diamond lights, and the disclosure of the patent (CN204032369U) does not discuss this problem. Also the small mini cotton electronic cigarette smoke parts inside require replacement at higher frequencies. What is desired is that the installation of mini electronic cigarettes be simple and robust at both ends of the mini electronic devices. The device in patent (CN204032369U) showing the mini electronic cigarette atomizers has various flaws that could be further improved upon.

SUMMARY OF THE INVENTION

The electronic cigarette is designed to overcome the difficulties of the previous version, creating an easy to install, secure, and effectively increase the amount and number of puffs of smoke for users of electronic cigarette devices. The electronic cigarette device has: a plurality of electronic cigarette, the central shaft of the bracket, the lower bracket, the cigarette holder, and the first frame. The first cigarette holder, bracket, the center of the upper shaft and the holder are connected in turn to the lower bracket. The electronic cigarette includes a housing, a first cigarette holder, bottom, atomizer, battery, airflow control sensor and silicone ring, the atomizer, the battery, the airflow control switch. The silicone ring is disposed in the housing inside. The first mouthpiece and the bottom cover are provided at both ends of said housing. The first mouthpiece, the atomizer, the battery, the airflow control sensor and to the bottom cover are sequentially arranged. The airflow control sensor is fixed to the housing by the silicone ring.

A first end of the central shaft housing is disposed on the support. A second end of the central shaft housing is disposed within the holder. The lower end surface of the bracket is provided with a plurality of first sockets. The first electronic cigarette cigarette holder is fixed to the first through-hole. The upper surface of the holder is provided with a plurality of second sockets, the tail end of the electronic cigarette sleeve is disposed in the second socket. A plurality of the electronic cigarettes are circumferentially distributed for display about the central shaft.

The first cigarette holder cigarette holder is provided with an end face of the jack, jack the mouthpiece communicating with the first socket: The second end of the central shaft has a connecting member. The connecting member and the lower bracket are joined at a threaded connection. The holder sleeve is secured by the lower outer bracket. The electronic cigarette also includes diamond light and a fixed ring. The light passes through the retaining ring fixed in the housing. The diamond lamp is positioned between the airflow control sensor and the bottom cover. A number of fan shaped holes are circumferentially distributed along the bottom surface of the entire column shaped device.

Preferably, the number of cigarette jacks are a multiple of two and are symmetrically arranged. Preferably, the first through-hole has a diameter gradually decreasing from the bottom of the hole. Preferably, the mouthpiece further comprises a second frame and a second mouthpiece, such that the mouthpiece and the second frame of the first mouthpiece are disposed at both ends of the second cigarette holder frame, and the center of the second frame is provided with a mouthpiece socket. The second mouthpiece is connected to the socket threads. The second frame and the first cigarette holder cigarette holder frame threaded connections.

Preferably, the nebuliser comprises a sleeve, fiberglass pipe, silicone members, cotton, tobacco and heating wire. The silicone member comprises an upper and a lower cylindrical cylinder. The cylinder on the lower cylinder diameter is smaller than the diameter. The fiberglass sleeves are provided on the upper outer cylinder. The sleeve jacket is provided on the lower outer cylinder. Silicone members are located between the sleeve and the battery. The heating wire and the smoke cotton are provided between the fiberglass tube and the sleeve. The heating wire passes through the silicone members to make electrical connection with the battery. Preferably, the cigarette jack has an inverted cone shape. Preferably, there is provided a pad of silica on the inner wall of the mouthpiece jack. Preferably, the first through-hole is laterally provided with a spacer located at the top of the first mouthpiece. Preferably, the number of the electronic cigarettes held within the device is six. Preferably, the electronic cigarette device is cylindrical in shape.

The electronic cigarette device should be simple in structure and a miniaturized portable device. This device takes the structure of a conventional electronic cigarette device in combination with multiple electronic cigarettes, pressurized amount of smoke, to meet the needs of smokers, through a single mouthpiece for single use, especially for Indian hookah that can be used by many people. Smokers can enjoy more mechanical configurations for various smoking games. In addition, individuals can also take out an electronic cigarette for smoking directly. The following combination of figures and examples further illustrate the practice of this invention.

The following callout list of elements can be a useful guide in referencing the element numbers of the drawings.

1 Second Mouthpiece
2 Second Mouthpiece Holder
3 First Mouthpiece Holder
4 Bracket
5 Central shaft
6 Electronic Cigarette
7 Holder
8 First Socket
9 Silicone Pad
10 Mouthpiece Socket
11 Sockets
12 Connector
13 Lower Bracket
14 Second Socket
15 Fan Shaped Hole
16 First Mouthpiece
17 Housing
18 Sleeve
19 Fiberglass Tube
20 Silicone members
21 Battery
22 Silicone Ring
23 Diamond Light
24 Bottom Cover
25 Retaining Ring
26 Lower Cylindrical Column
27 Upper Cylindrical Column
28 Spacer

DETAILED DESCRIPTION OF THE PREFERRED EMBODIMENT

Figure 1:
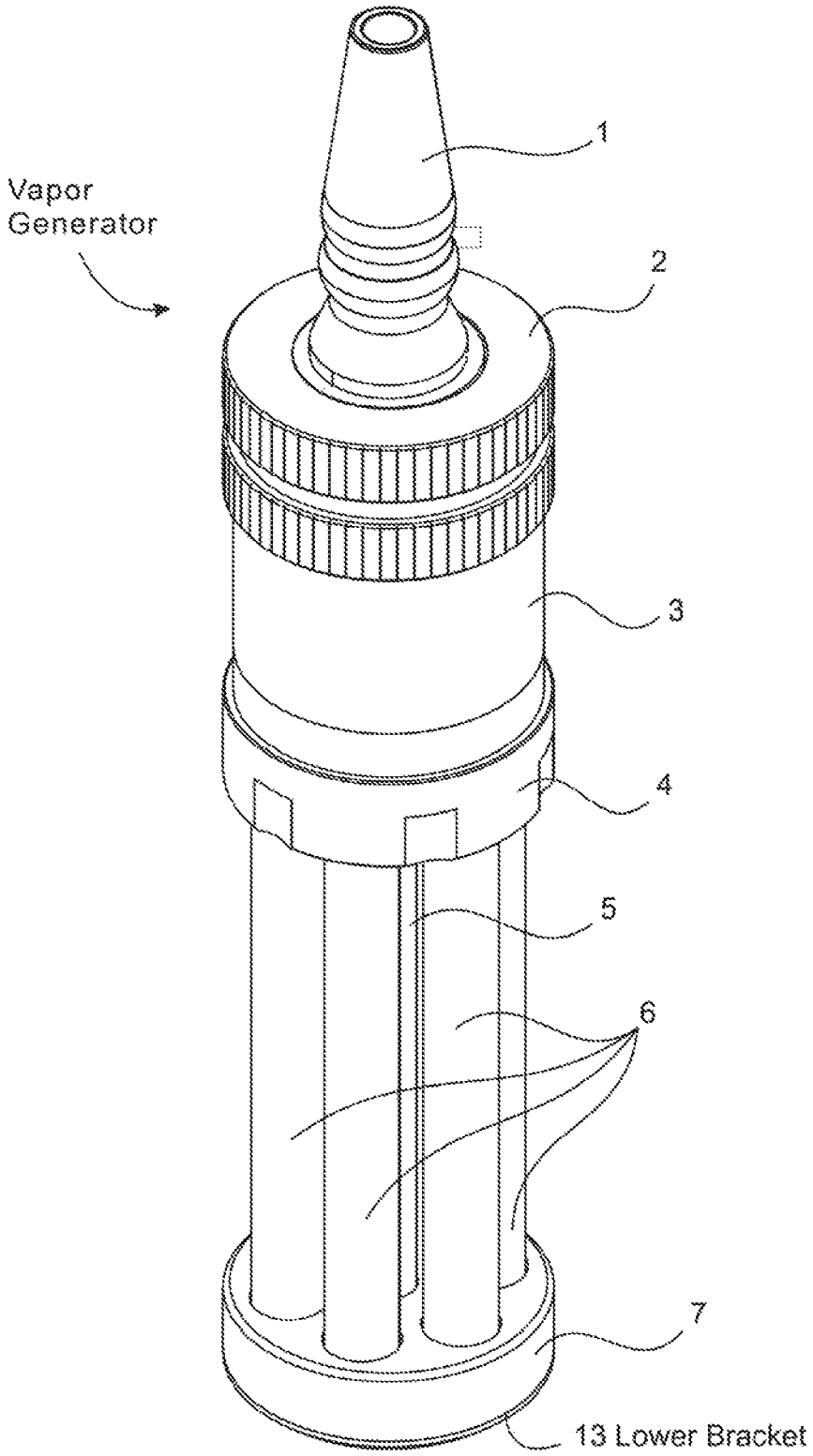
FIG. 1 is a perspective view of the electronic cigarette device.
Figure 2:
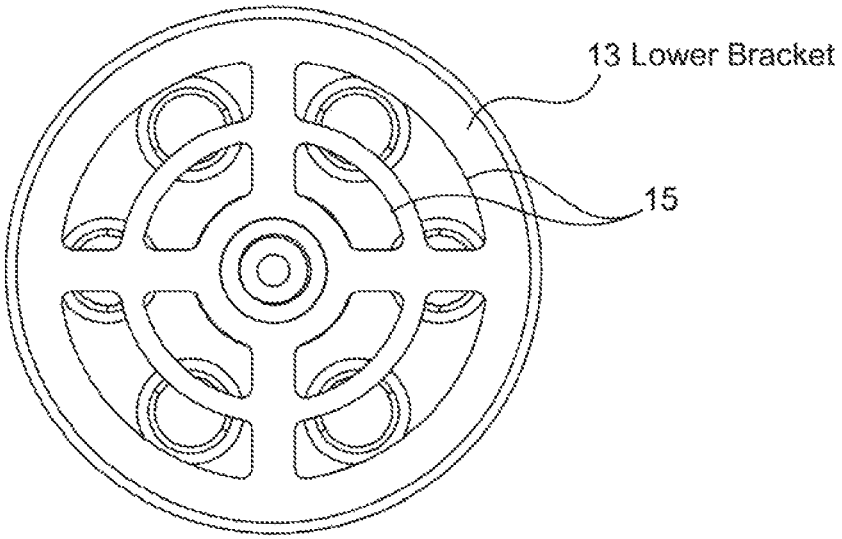
FIG. 2 is a bottom view of the electronic cigarette device.
Figure 3:
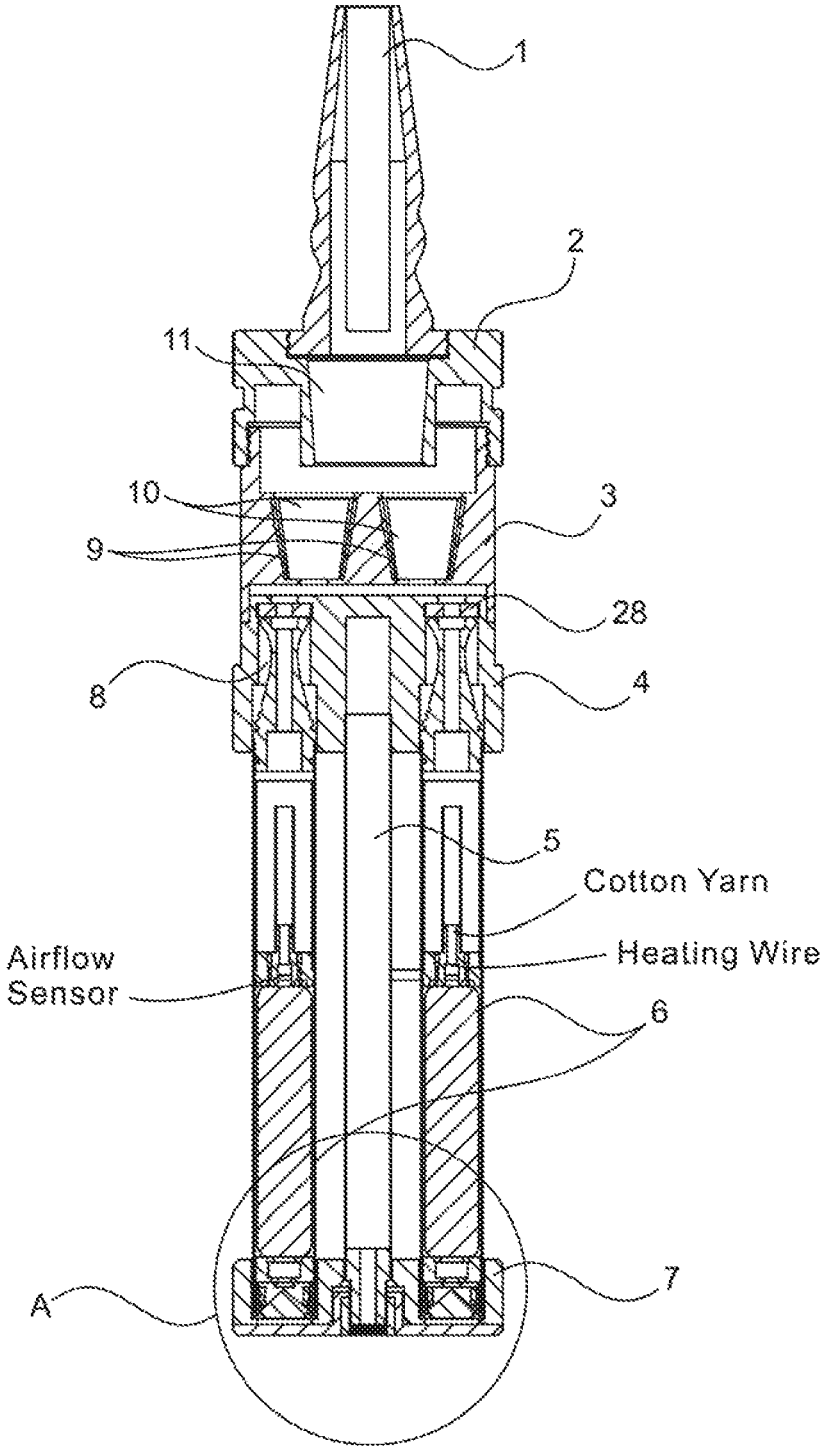
FIG. 3 is a cross-sectional view of the utility of the new electronic cigarette device.
Figure 4:
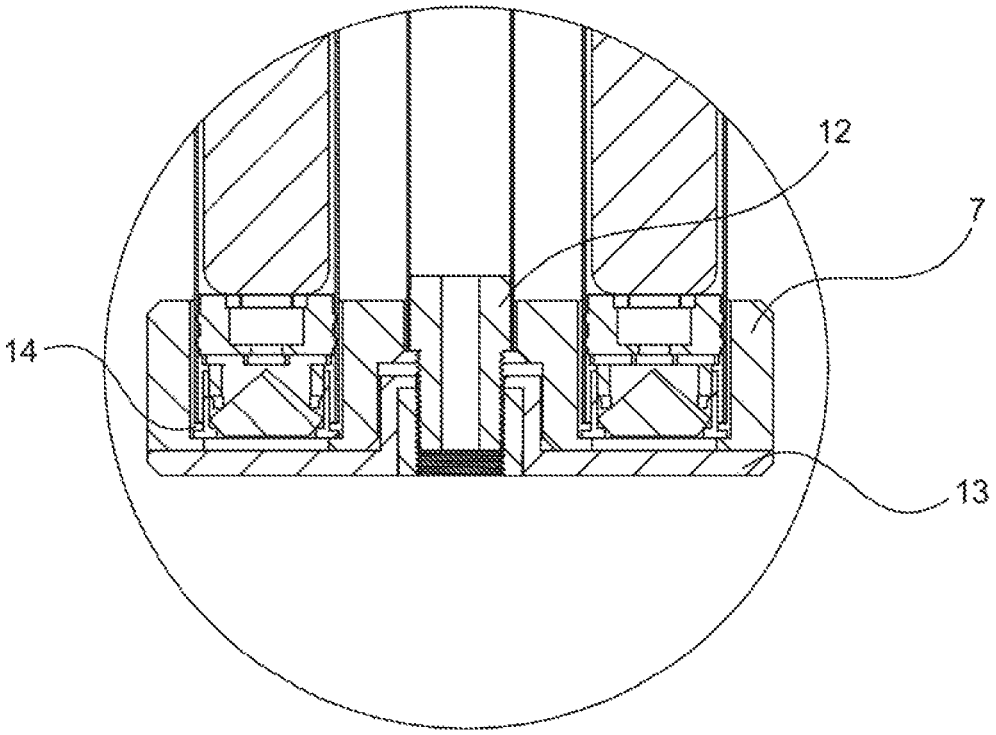
FIG. 4 is an enlarged view of FIG. 3 portion A.
Figure 5:
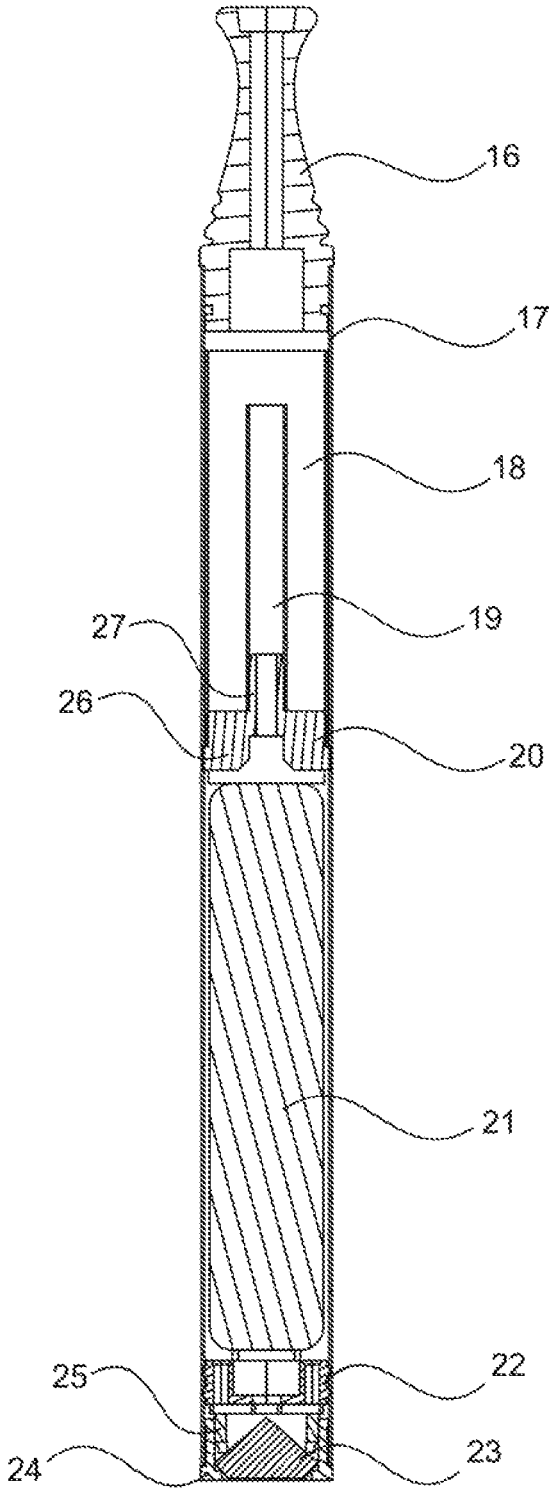
FIG. 5 is a cross sectional view.

The present invention has three modes of use. As shown in FIG. 1, the electronic cigarette device has: a plurality of electronic cigarettes 6; a central shaft 5; a bracket 4; a lower bracket 13; a holder 7; and a first mouthpeice holder 3. The first 3 cigarette holder, the bracket 4, the central shaft 5, and lower support holder 13 are connected to each other such as by threaded connection. The electronic cigarettes 6 can be releasably loaded and removed from the electronic cigarette device. Each electronic cigarette 6 includes a housing 17, a first mouthpiece 16, a bottom cover 24, an atomizer, a battery 21, a airflow control sensor and a silicone ring 22. The atomizer is also called a nebulizer, smoker or vapor generator and by combining six of them together in parallel, one can generate six times the vapor. The atomizer, battery 21, airflow control sensor and silicone ring 22 are disposed within the housing 17. The first mouthpiece 16 and the bottom cover 24 are connected to both ends of the housing 17 and can be formed as end caps. The first mouthpiece 16, the nebulizer, a battery 21, airflow control switches and bottom cover 24 are arranged in order from top to bottom on each electronic cigarette 6. The silicone ring 22 secures the airflow control sensor in the housing 17.

The central shaft 5 provides a clamping bias to retain the electronic cigarettes in a modular fashion to the sockets formed in the holder 7 at a lower end and to the sockets formed the bracket 4 at an upper end. The central shaft 5 has a first end which is an upper end is connected to the bracket 4 and can be made in a telescopically retracting manner to provide a clamping bias such as by a spring or twisting threaded connection. The central shaft 5 also has a second end which is a lower end 5 connecting to the holder 7. The bracket 4 is provided with a plurality of first sockets 8 on a lower surface of the bracket 4 such as inside the sockets of the bracket 4.

The electronic cigarette 6 first mouthpiece 16 is held in the first socket 8 in preferably an airtight seal so as to allow a user to inhale through all six of the first mouthpieces 16 to bring the vapor through the second mouthpiece 1 to the user. The upper surface of the holder 7, which can be configured as a mounting bracket, is provided with a plurality of second sockets 14 that can allow airflow through the electronic cigarette 6. If the electronic cigarette 6 has a lower end that has an air inlet, then air can pass through the second socket 14 and continue to the lower end of the electronic cigarette. The sockets formed in the upper surface of the holder 7 for retaining the lower ends of the electronic cigarettes 6 can simply have a larger diameter than the electronic cigarette 6 so as to provide a gap for airflow 7. Most electronic cigarettes 6 may have air inlet openings above the battery, but this configuration allows for an air inlet below the battery as well as above the battery to allow a more universal fit.

A user uses the device by first obtaining a plurality of electronic cigarettes 6 and then circumferentially installing them around the central shaft 5 to expose and display an equidistantly distributed display of electronic cigarettes. The user lodges the first mouthpiece 16 in the socket formed on the upper surface of the bracket 4, and since the socket has a first mouthpiece holder 3, the electronic cigarette is thus securely lodged. A mouthpiece hole 10 automatically aligns so that it fluidly communicates with the first socket 8 to allow passage of vapor that is supplied to the user when the user inhales. Since the user is inhaling six electronic cigarettes rather than just one, the user will be receiving six times the vapor but most importantly more than six times the fun, and much better healthwise than smoking regular cigarettes.

If the central shaft 5 is not telescopically connected to the bracket 4, or even if it is, the electronic cigarettes 6 can still be loaded by the user adjusting the lower bracket 13 which allows for fine tuning release and installation of the electronic cigarettes 6. The second end of the central shaft 5 can be a sleeve shaped like a tube so that it receives by interference fit or otherwise, a connecting member 12 for connecting to the lower bracket. The connecting member 12 can be threaded to the lower bracket 13 so that rotation of the lower bracket 13 changes the distance between the lower bracket 13 and the central shaft 5 sleeve holder 7 provided in the lower bracket 13 outside. The user can adjust the lower bracket 13 is a fine-tuning adjustment, in conjunction with a telescopic connection between the central shaft 5 and the bracket 4, or not.

The user preferably selects electronic cigarettes 6 that also include a diamond light 23 so that these can be seen through the fan-shaped openings as a cluster of LED indicators for indicating an active vapor generating state of the electronic cigarette 6. Preferably, the electronic cigarettes 6 have automatic airflow sensors that activate the heater coil, atomizer or nebulizer automatically. The user can adjust the retaining ring 25 located between the bottom cover 24 and diamond light 23 after cleaning to ensure a good fit. The bottom cover 24 retains the diamond light 23 by receiving the retaining ring 25 which is secured to the housing 17. The diamond light 23 also has a airflow control sensor which is also adjacent to the bottom cover 24. The lower bracket 13 is formed with a plurality of fan-shaped holes 15 distributed circumferentially around the entire lower portion of the housing 17 formed in the shape of a column.

Preferably, the vapor generated passes through a pair of mouthpiece sockets 10 formed on a top portion of the bracket 4. These mouthpiece sockets 10 allow the end of the tubing for Indian hookah mouthpieces to be optionally installed, with one mouth the socket for each Indian hookah connection. After the user finishes the Indian hookah session, the mouthpiece sockets 10 can be adapted to the second mouthpiece holder 2 for receiving the second mouthpiece 1.

A key inventive improvement in this device is for the lower end face of the holder 4 to be provided with a plurality of first sockets 8. The electronic cigarette 6 has a first mouthpiece 16 that is held in the first through-hole 8. A set of second sockets 14 are formed on an end face of the holder 7. The electronic cigarettes 6 are shaped to fit into the second sockets 14. The second end of the central shaft 5 of the inner sleeve has a connector 12 for threaded connection to the lower bracket 13. The holder 7 is biased and retained by the lower bracket 13 disposed at an outside portion of the holder 7.

The first socket 8 has a diameter gradually decreasing from the bottom of the socket to coincide with a tapered profile of the first mouthpeice. A user installs the electronic cigarette by first inserting the mouthpiece into the first socket. Then the user sets the lower end of the electronic cigarette in the second socket. The connecting member is connected on the central shaft sleeve so that a user can tighten the lower bracket 13 via the threaded connection so that it abuts and biases the holder 7 upward to clamp the electronic cigarette. The electronic cigarette ends are respectively secured between the bracket 4 and holder 7.

The second key improvement is that the electronic cigarette 6 also includes a diamond light 23 and a retaining ring 25. The diamond light 23 is fixed within the housing 17 via a retaining ring 25. The diamond light 23 is located between the airflow control sensor and the bottom cover 24. The bottom cover 24 has a through-hole and diamond light 23 fitting. The lower bracket is provided with a plurality of fan-shaped holes 15. The plurality of fan-shaped holes 15 are distributed on the circumference of the entire column 13.

Providing fan-shaped holes allows the user to see the diamond lights 23 which enhances the aesthetics and functionality of the electronic cigarette device. The diamond light 23 is not a real diamond that is lighted but rather is a light that has a sparkly, prismatic, or iridescent diamond shaped lens that looks like a sparkling diamond. The spacer 28 is a supporting plate that can have variable thickness or can be stacked in multiples so that a user can adjust for slight variations in electronic cigarette length. The airflow control switches can be a manual switch, an airflow sensor or a transducer such as a microphone which activates the heated coils so that electronic cigarette smoke can be generated from the oil soaked cotton.

A third key improvement is the modular second mouthpiece 1 and the second frame 2 to switch from single-user portable mode to an Indian hookah mode. The second mouthpiece 1 is in airflow connection with the second mouthpiece holder 2 and the first mouthpiece holder 3. The second ends of the second mouthpiece holder 2 have a second frame. The second frame has a centrally located pair of mouthpieces sockets. Each socket 11 and the second mouthpiece 1 are connected to a threaded connection. Also, the second mouthpiece holder 2 and the first mouthpiece holder 3 can be connected together by a threaded connection. By using the modular second mouthpiece 1, the present invention has yet another convertible configuration a conversion between a single user mode from a double user mode.

In the electronic cigarette, the atomizer includes a sleeve 18, a fiberglass tube 19, silicone member 20, heating wire for heating cotton and tobacco. The silicone member 20 includes an upper cylinder 27 and the lower cylinder 26. The diameter of the lower cylinder 26 is less than the diameter of the upper cylinder 27. A fiberglass tube 19 is mounted on the cylindrical sleeve 27. The sleeve 18 is provided at the cylindrical sleeve 26. The silicone member 20 is positioned between the sleeve 18 and the battery 21. Heat and smoke from the cotton yarn passes through the fiberglass tube 19 and the sleeve 18. The sleeve 18, the tube 19 and the silicone member 20 are in fluid connection with the heating wire chamber above the battery 21.

Optionally, the mouthpiece sockets 10 are formed as cigarette jacks that have an inverted cone profile. The mouthpiece socket 10 preferably has an inner wall that is lined with a silicone pad 9 to provide an airtight gasket seal. The silicone pad 9 improves India hookah connections to prevent leakage. If the cigarette jack has an inverted cone profile, the silicone pad likewise should also have an inverted cone profile. The first socket 8 is provided with a transverse spacer 28, the spacer 28 is located at the top of the first mouthpiece 16. The transverse spacer 28 can also be a silicone gasket that provides a better seal between the first mouthpiece and the mouthpiece socket 10. The preferred number of electronic cigarettes 6 is six.

Thus, the user of the device has three modes to select from. In the single user mode, the user can use the device with all six electronic cigarettes mounted and the single outlet second mouthpiece 1 installed. In the distributed user mode, the user can remove the electronic cigarettes and distribute them among friends for example. In the shared user mode, all six electronic cigarettes are mounted and multiple users can share all six of them using an Indian hookah connection using the dual mouthpiece socket 10. The shared user mode is also called the Indian hookah mode even when people are not smoking Indian hookah. Indian hookah mode requires that each user have their own air tube for inhaling vapor from the multiple mode vapor generator.

The airflow control switch can be a manual switch that the user activates by pressing the bottom of the electronic cigarette. When depressed, the switch activates the vapor generation. In shared user mode or in single-user mode, the manual switch could be a button on the bottom of the electronic cigarette near the light. The airflow control switch could be activated by pressing the lower bracket 13, which then translates the pressure to the bottom cover 24.

The airflow control switch can also be an electronic airflow sensor in the best mode. A wide variety of different airflow sensors can be used such as a pressure transducer, a microphone, or a thin membrane. In the case of an airflow sensor, the airflow sensor can be triggered when a user inhales and the airflow sensor senses a difference in air pressure. Preferably, the airflow control sensor is mounted at the bottom tip of the electronic cigarette. The control sensor tells the control to light up the heating coils so as to generate vapor. Fluid communication means that a fluid such as air can pass around, among, through or between members.

The above described embodiments are merely one technical implementation for enabling those skilled in the art to understand the content of the invention, and as such the claims should not be limited only to this embodiment. Obvious modifications to this disclosure can remain within the spirit of the disclosure and still fall within the scope of the claims as recited below.

The invention claimed is:

1. A multiple mode vapor generator, comprising:

a. a plurality of electronic cigarettes, wherein each electronic cigarette further includes a housing, a first mouthpiece at an upper end of the electronic cigarette, a batter, a vapor generator, and a bottom cover at a lower end of the electronic cigarette;

b. a central shaft, wherein the plurality of electronic cigarettes are removably mounted around the central shaft, wherein the central shaft is telescopically retracting;

c. a bracket connecting to an upper end of the central shaft, wherein the first mouthpiece is mounted to a first socket formed on the bracket, wherein the first mouthpiece has a fluid communication with the first socket;

d. a holder connecting to a lower end of the central shaft, wherein the bottom cover fits at least partially within a second socket formed on the holder; wherein the central shaft, bracket and holder are configured to provide modular release of any, one, or all of the plurality of electronic cigarettes, wherein the bracket and holder are configured to clamp the plurality of electronic cigarettes between the first socket and the second socket, wherein the multiple mode vapor generator operates in a first mode where the plurality of electronic cigarettes are activated together and in a second mode where the plurality of electronic cigarettes are activated.

2. The multiple mode vapor generator of claim 1, further comprising an airflow sensor mounted to the housing in each of the plurality of electronic cigarettes for automatic activation of each of the plurality of electronic cigarettes.

3. The multiple mode vapor generator of claim 2, wherein the airflow sensor is mounted using a silicone ring on the bottom cover located on each of the plurality of cigarettes.

4. The multiple mode vapor generator of claim 2, wherein a first mouthpiece holder has a pair of mouthpiece sockets including a first mouthpiece socket and a second mouthpiece socket that are in fluid communication with each of the first mouthpiece of each of the plurality of electronic cigarettes, wherein the pair of mouthpiece sockets allows operation in a shared mode so that a first user can access the first mouthpiece socket and a second user can access the second mouthpiece socket.

5. The multiple mode vapor generator of claim 4, wherein the pair of mouthpiece sockets are formed on an upper surface of the bracket, wherein the mouthpiece sockets are both in fluid communication with each of the first sockets and consequently also each of the first mouthpieces.

6. The multiple mode vapor generator of claim 2, wherein each of the electronic cigarettes further includes a diamond light retained by a retaining ring that secures the diamond light to the housing.

7. The multiple mode vapor generator of claim 6, further including a lower bracket mounted to the holder, wherein the lower bracket has plurality of holes that are circumferentially distributed around the lower bracket to reveal the diamond lamp.

8. The multiple mode vapor generator of claim 6, with the first socket being gradually reduced in diameter from its bottom to fit to a contoured profile of the first mouthpiece.

9. The multiple mode vapor generator of claim 2, further comprising: a second mouthpiece mounted on a second mouthpiece holder, wherein the second mouthpiece holder is mounted on a first mouthpiece holder that in turn is connected to the bracket.

10. The multiple mode vapor generator of claim 2, wherein each electronic cigarette comprises: a sleeve, a fiberglass tube, a silicone member, and a heating wire.

11. The multiple mode vapor generator of claim 10, wherein the silicone member includes an upper cylinder and a lower cylinder, wherein the upper cylinder has a diameter that is smaller than a diameter of the lower cylinder, wherein the fiberglass tube fits on the upper cylinder.

12. The multiple mode vapor generator of claim 11, wherein the lower cylinder, silicone member and sleeve are mounted above the battery, wherein a cotton yarn is disposed between the fiberglass tube and the sleeve wherein the heating wire passes through the silicone member for electrical connection to the battery.

13. The multiple mode vapor generator of claim 11, wherein: a first spacer is configured to provide a gasket seal with the first mouthpiece to facilitate fluid communication.

14. A multiple mode vapor generator, comprising:

a. a plurality of electronic cigarettes, wherein each electronic cigarette further includes a first mouthpiece at an upper end of the electronic cigarette, a battery, a vapor generator and a bottom cover at a lower end of the electronic cigarette;

b. a central shaft, wherein the plurality of electronic cigarettes are removably mounted around the central shaft, wherein the central shaft is telescopically retracting;

c. a bracket connecting to an upper end of the central shaft, wherein the first mouthpiece is mounted to at least three first sockets formed on the bracket, wherein the mouthpiece has a fluid communication with the first socket;

d. a holder connecting to a lower end of the central shaft, wherein the bottom cover fits at least partially within at least three second sockets formed on the holder; wherein the central shaft, bracket and holder are configured to provide modular release of any, one, or all of the plurality of electronic cigarettes, wherein the bracket and holder are configured to clamp the plurality of electronic cigarettes between the at least three first sockets and the at least three second sockets, wherein the multiple mode vapor generator operates in a first mode wherein the plurality of electronic cigarettes are activated together and in a second mode where the plurality of electronic cigarettes are activated.

* * * * *